United States Patent [19]

Eckel

[11] Patent Number: 4,951,351

[45] Date of Patent: Aug. 28, 1990

[54] AUTOMATIC CLOSURE MECHANISM FOR DOUBLE-ACTING DOORS

[75] Inventor: Alan Eckel, Westford, Mass.

[73] Assignee: Eckel Industries, Inc., Cambridge, Mass.

[21] Appl. No.: 721,192

[22] Filed: Apr. 9, 1985

Related U.S. Application Data

[63] Continuation-in-part of Ser. No. 586,249, Mar. 5, 1984, abandoned.

[51] Int. Cl.[5] ..... E05F 3/20

[52] U.S. Cl. ..... 16/254; 16/285; 16/303; 16/314; 16/315

[58] Field of Search ..... 16/284, 285, 303, 312–315, 16/317, 318

[56] References Cited

U.S. PATENT DOCUMENTS

| | | | |
|---|---|---|---|
| 1,845,477 | 2/1932 | Bommer | 16/315 |
| 2,840,848 | 7/1958 | Hickey | 16/313 |
| 3,263,365 | 8/1966 | Eckel | 16/314 X |
| 4,215,449 | 8/1980 | Loikitz | 16/303 X |

*Primary Examiner*—Frank T. Yost
*Assistant Examiner*—Rinaldi Rada
*Attorney, Agent, or Firm*—Schiller, Pandiscio & Kusmer

[57] ABSTRACT

An improved automatic door closure is provided for a door which has a door post mounted by two or more members attached to a door jamb. The door closure comprises a roller which is mounted on the door jam, a cam which is mounted on the door post so that it will rotate with the door post but is capable of limited movement relative to the post in an axial direction, and a spring for urging the cam against the roller as the door is swung between open and closed positions. The cam is contoured so as to cause it and the roller to coact with spring arranged to cause the door to return from open to closed position without any operator applied force. In a preferred embodiment of the invention, the door closure apparatus comprises a compression spring for urging the door to close, and an adjustable mechanism for varying the force exerted by that spring.

26 Claims, 5 Drawing Sheets

AUTOMATIC CLOSURE MECHANISM FOR DOUBLE-ACTING DOORS

This is a continuation-in-part of my copending Application Ser. No. 586,249, filed Mar. 5, 1984 for Door Closure Hardware now abandoned.

The present invention pertains to improved door-closing hardware; more specifically, it relates to an improved form of cam hardware for causing a door to close automatically.

PRIOR ART

Door hardware that uses a cam and roller arrangement to provide a self-positioning door is well known. Normally, hardware of this type includes a rotatable door post to which the door is mounted. The post is rotatably supported by two bearings fixed to the door jamb, a lower bearing and an upper bearing that has a curved upper surface that also functions as a cam. A cam follower attached to the upper end of the door post comprises a roller member which coacts with the curved upper surface of the cam to cause the door to be self-closing. When the door is in its normally closed and at-rest position, the roller member rests in a depression or low point in the upper surface of the cam. When the door is opened in either direction, the roller rides out of the depression up an inclined portion of the curved surface to a higher point. The door and door post move upwardly relative to the bearings as the door is opened. Consequently when the door is subsequently released, gravity will urge the roller to move back down the inclined surface to the cam's low point thereby causing the door to rotate back to its normally closed position. Self-closing doors utilizing door hardware of this type are exemplified in U.S. Pat. Nos. 4,122,887; 4,124,955; and 4,292,764; and in the references cited therein.

One limitation of this type of door cam hardware arrangement is that dirt can accumulate on the curved upper surface of the upper bearing. Eventually, enough of this dirt may collect on the upper surface to interfere with proper operation of the roller on the cam surface. A second and more important limitation of such hardware is that the door moves vertically as it and closes. This vertical shifting of the door panel makes it difficult to seal the complete passageway when the door is closed.

Another prior art arrangement utilizes the same hardware described above together with a compression spring positioned around the door post below the lower bearing in order to provide a resistance force against the force required to push the door open. This arrangement has essentially the same limitations as the first-described prior art cam hardware.

Another form of prior art door cam hardware comprises an inverted crown cam member non-rotatably mounted on the upper end of the door post so as to slide axially up and down the post a predetermined distance while being contained at the top of the post. This cam has a substantially flat side surface which is slidably positioned against the door jamb so as to prevent rotation of the cam member about the door post. A compression spring is positioned above the cam and exerts a downward force on the cam. A roller-type cam follower is nonrotatably and nonslidably fixed to the door post just below the cam member so that the roller travels down the inverted cam member's inclined lower surface when the door is opened in either direction.

Door hardware of this type is exemplified in U.S. Pat. No. 3,263,365 and in the references cited therein Door hardware, of the type shown in U.S. Pat. No. 3,263,365 is limited by alignment, lubrication and noise problems in addition to the problems of other hardware previously described.

Additional problems with these door closures arise with accuracy of closure and sealing, especially with large industrial type doors Large industrial doors close large passages and are intended to block significant flows of heated or cooled air. However, they tend to be subjected to heavy and abusive traffic. The results can be poorly functioning doors, either from damaged or inadequate closure mechanisms. Where gravity is used as the closing force, door closure is slow and may tend to be inaccurate. Where a spring is used to increase the restoring force, mounting the spring on site can be treacherous. The powerful spring used in a heavy door can be quite difficult to simultaneously position and pre-load, and accomplishing this can be time-consuming. Also proper functioning of a door depends in part on the alignment of the door to the door frame. Again the leveling of a door either initially or as a repair or replacement of a panel can be a time-consuming process, especially in large or heavy doors. Still another problem is how to shroud the closure mechanism so air does not leak past it. This can be accomplished with a compact mechanism. However, providing a simple, compact, easily installed door-closing mechanism that adequately closes large doors for accurate sealing while being itself shroudable has proven to be a difficult combination to achieve.

OBJECTS OF THE PRESENT INVENTION

It is therefore a general object of this invention to provide improved cam-type door-closing hardware that eliminates, or substantially reduces, the problems noted above.

A more specific object is to provide cam-type door-closing hardware that allows the door to remain at a fixed height as it swings open or shut.

A further object is to provide improved cam-type door-closing hardware which is reliable, can be produced at a relatively low cost, and is designed so as to facilitate door installation.

Still another object of this invention is to provide improved cam-type door-closing hardware which facilitates the installation of an air seal around the hardware so as to minimize air leakage through the doorway.

Finally, it is an object of the invention is to provide cam-type door-closing hardware which facilitates leveling the door quickly and easily.

SUMMARY OF THE PRESENT INVENTION

Attainment of these objectives is achieved by new door-closing hardware which comprises a roller fixed to a door jamb, a cam adapted to be slidably supported by a door post along with a spring, and two door post bearings which axially align and rotatably support the door post. The cam has a "high" rest point, a diametrically opposed "low" point, and inclined surfaces connecting the two. The hardware is attached so that (a) the roller and cam are engaged under the influence of the spring, (b) the cam can rotate with the door about the axis of rotation, and (c) the cam can undergo limited travel along said axis. When the door is in its closed position, the roller is positioned at the high rest point of the cam. When the door is opened, the cam rotates with the door about the axis of rotation. As it does so, the roller imparts an axial force to the cam, shifting the latter axially against the spring. When the door is released while in open position, the pressure of the spring forces the cam against the roller, thereby imparting a rotational force to the door so as to restore the door to its closed position.

BRIEF DESCRIPTION OF THE DRAWINGS

In the several figures, like parts are designated by like numerals.

DESCRIPTION OF THE PREFERRED EMBODIMENT

Figure 1:
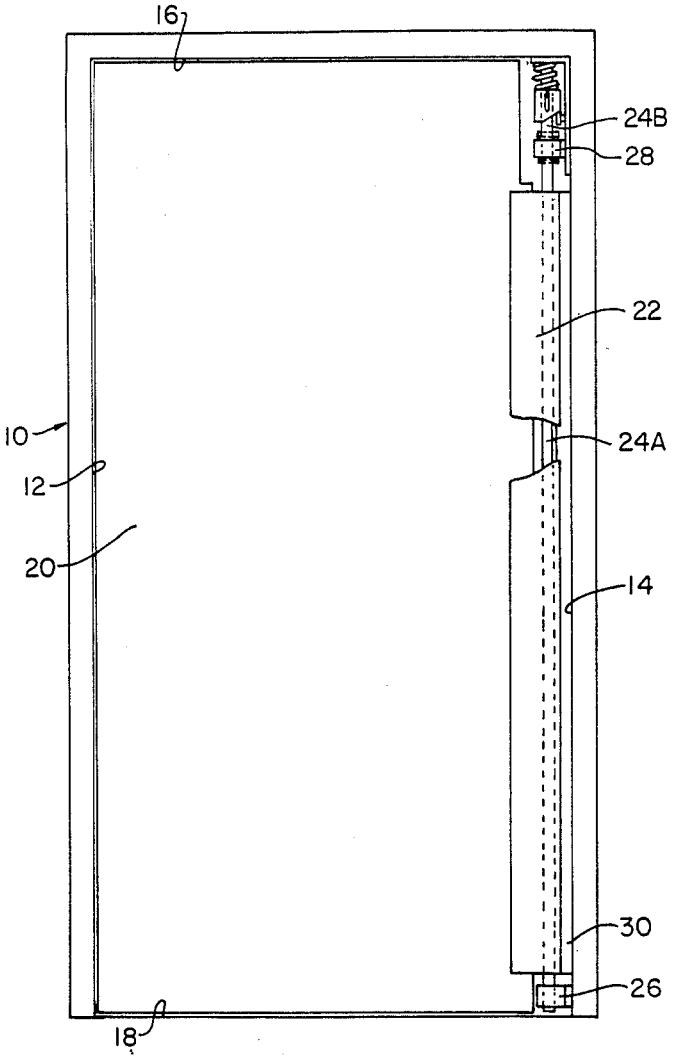
FIG. 1 is a front view in elevation of a door mounted with cam-type hardware embodying the present invention.

Referring now to FIG. 1, that drawing illustrates a door frame 10 comprising an outer jamb 12, an inner jamb 14, a lintel 16 and a sill 18. Hung in the frame is a door 20. The door is attached by means of a conventional door mount 22 (see elements 54 and 56 of U.S. Pat. No. 3,212,561 and element 26 of U.S. Pat. No. 4,292,764) to a door post assembly that comprises a lower section 24A and an upper section 24B. In this embodiment of the invention the upper door post section 24B is a hollow tube. Lower door post section 24A preferably is a hollow tube, but it may be a solid rod. The door post assembly is rotatably supported by a lower journal or bearing 26 and an upper journal or bearing 28, both attached to inner jamb 14. Preferably, but not necessarily, a flexible and resilient sealing flap 30 is attached to and extends along the door panel edge facing the inner jamb 14. Flap 30 is made of any suitable material, e.g., rubber reinforced with a fabric. The flap is sized so that it stays in engagement with the door jamb as the door is swung between its open and closed positions. Similar sealing flaps may be attached to the front edge of the door so as to engage the outer door jamb 12, and also to the upper and/or lower edges of the door for engagement with lintel 16 and/or sill 18.

Figure 2:
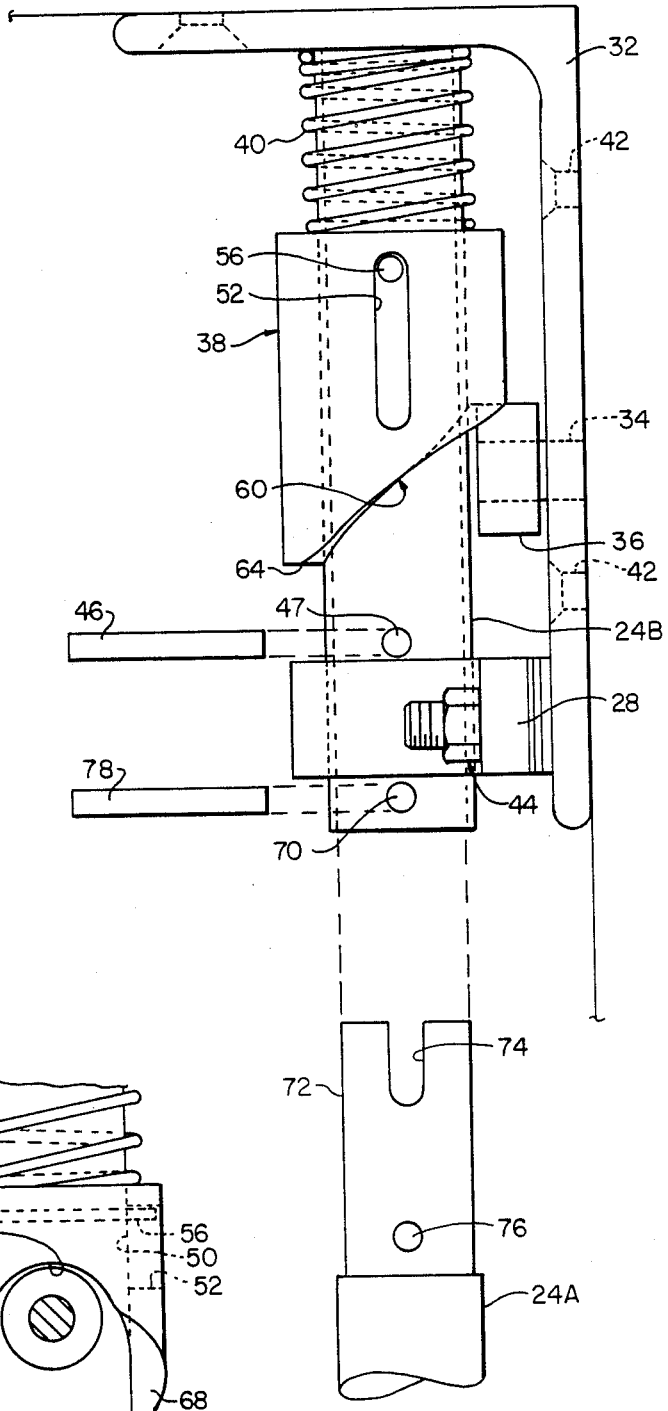
FIG. 2 is an enlarged fragmentary view, with certain parts shown in section or in exploded relation, of the cam hardware of FIG. 1.
Figure 3:
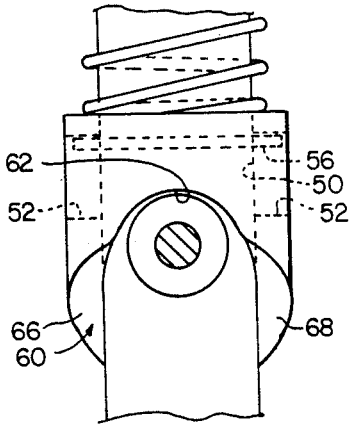
FIG. 3 is a sectional view in side elevation taken along line 6—6 of FIG. 2.

Associated with the door is a door-closing cam hardware unit (FIGS. 1–3). The door-closing cam hardware unit comprises upper bearing 28, an angle iron 32, a roller assembly constituting a stub shaft 34 and a circular roller 36, the upper section 24B of the door post assembly, a cam 38, and an external load spring 40. This hardware unit is preferably factory assembled so as to facilitate quick on-site installation.

Referring now to FIGS. 1 and 2, angle iron 32 acts as a mounting support for the door closure mechanism and has the advantage that it can be shimmed to properly mount the door in a door frame in the event the door frame is not square. The angle iron is mounted on-site to the door frame by means of screws 42. Upper bearing 28 is anchored to angle iron 32 by suitable means, e.g., by of a pair of bolts and nuts identified generally at 44.

Referring now to FIG. 2 as well as FIG. 1, stub shaft 34 is preferably welded to angle iron 32, but the two may be affixed to one another by other suitable means. Roller 36 is mounted on the outer end of stub shaft 34 and cooperates with cam 38 in the manner hereinafter described to cause the door to be self-closing. Cam 38 is slidably mounted on the upper post section 24B. The latter is rotatably mounted in upper bearing 28. A first roll pin 46 is mounted in a pair of diametrically opposed holes 47 in upper post section 24B and has a length such that its ends extend over and engage the upper edge of upper bearing 28. Spring 40 is a compression spring. This spring surrounds the upper door post section 24B and has its upper end in engagement with angle iron 32 and its lower end in engagement with the upper surface of cam 38. Spring 40 is under compression and functions to maintain cam 38 in engagement with roller 36.

Cam 38 has a cylindrically shaped center bore 50 (FIG. 3) sized so that it can slidably accommodate the upper door post section 24B. The cam also has a pair of diametrically opposed holes 52 (FIG. 2) which are elongated in a direction parallel to the center axis of the cam. Holes 52 intersect center hole 50 and have a width (measured circumferentially of the cam) which is sized so as to slidably accommodate the outer ends of a guide pin 56 while restraining the cam against rotation relative to door post section 24B. Guide pin 56 is force-fitted in two diametrically opposed and elongate holes in upper door post section 24B and has a length which exceeds the outer diameter of the upper door post section by an amount sufficient for it to extend into the elongate holes 52 of the cam.

Referring to FIGS. 2 and 3, cam 38 has a contoured face represented generally at 60 which is in engagement with the roller 36. Surface 60 has a "high" rest point 62 which is the point engaged by roller 36 when the door is closed. Surface 60 also has a "low" point 64 situated approximately 180 degrees from the high rest point.

As seen in FIG. 3, high rest point 62 is actually a shallow circularly curved depression which has a radius of curvature substantially equal to the outer surface of roller 36. Additionally elongated holes 52 and guide pin 56 are located so that (a) high rest point 62 is aligned with roller 36 when the door is in closed position, and (b) when spring 40 presses the cam high rest point into engagement with roller 36, the ends of guide pin 56 will be at the upper ends of elongated holes 52. As a consequence high rest point 62 and roller 36 coact to provide a detent-like action which holds the door in closed position until a predetermined turning force is applied to the door. In practice the depression is made deep enough to prevent the door from opening under the force of a strong wind, e.g., a wind of 30–40 miles per hour.

In the embodiment illustrated in FIGS. 1–3, the shape of the low point 64 is not critical and the limit to which the door may be swung open is not determined by the length of elongated holes 52 and the diameter of guide pin 56. Instead the holes 52 are made so that the limit to which the door may be swung open in either direction is determined by engagement of the door with a door stop (not shown) which may be a floor-mounted or wall-mounted device. Preferably the door stop(s) allow the door to be swung open at least 90 degrees from its closed position. Thus, in the embodiment of FIGS. 1–3 the low point 64 is a flat surface removed ninety degrees from rest point 62 and the length of holes 52 is such that guide pin 56 reaches the lower ends of holes 52 after the door has been swung open in excess of 90 degrees.

Obviously, the embodiment of FIGS. 1–3 may be modified so that the limit to which the door may be swung open may be determined by the length of elongated holes 52 and the diameter of grid pin 56. Alternately, the low point 64 may be shaped to function as an "end-of-travel" point, i.e., shaped so as to function to determine the limit to which the door may be swung open.

Between the two points 62 and 64, cam surface 60 is provided with a pair of inclined surfaces 66 and 68 which are mirror images of one another. It is to be noted that surface 60 is contoured lengthwise (i.e., in a circumferential direction about the center axis of the cam), but all portions of that surface are flat widthwise (i.e., flat in a radial direction). The length of elongated openings 52 is set so as to allow cam 38 to slide axially along the upper door post section 24B to the extent required to permit the cam to rotate in either direction between a first position in which roller 36 is engaged with high rest point 62, and a second limit position in which roller 36 engages surface 60 at or just short of low point 64.

In this embodiment, the upper door post section 24B is made hollow so as to accommodate the upper end of the lower door post section 24A. The upper door post section 24B has a pair of diametrically opposed holes 70 located below the upper journal bearing 28. Referring to FIG. 2, the upper end of lower door post section 24B has a reduced diameter as shown at 72. This reduced diameter upper end is sized so as to make a snug telescoping fit in the lower end of the upper door post section 24B. This reduced diameter upper end of door post section 24A is provided with a pair of axially extending diametrically opposed slots 74 which are sized so as to snugly accommodate portions of guide pin 56. Door post section 24A also has a pair of diametrically opposed holes 76 which are located so as to mate with holes 70 when it is inserted into the upper door post section far enough for guide pin 56 to be located in slots 74. The two door post sections are secured together by a second roll pin 78 which is force fitted into holes 70 and 76. Roll pin 78 is long enough for its ends to extend beneath the lower surface of upper journal 28, and holes 70 and 76 are located so that there is just enough clearance between the roll pin and the journal to allow the door post and the cam to rotate relative to the two bearings.

The combined action of these parts is as follows: When the door is closed, the high rest point of cam 38 is engaged by roller 36 as shown in FIGS. 1–3. As the door is swung open, cam 38 rotates with the door post assembly and thereby causes its surface 60 to shift relative to roller 36. Since the position of the roller is fixed, it coacts with inclined surface 66 (or 68 as the case may be) to cause cam 38 to slide up along the door post assembly As 38 is lifted lengthwise of the door post assembly, it compresses external load spring 40. This continues until the door reaches the limit to which it can open. The door rests in this open position until the force which shifted it to open position is removed. At that point, the door will begin to close automatically.

The closing action of the door is the reverse of the above action. When the door is opened, spring 40 is compressed further. The energy stored in spring 40 causes the latter to press cam 38 against roller 36, with the result that the inclined face 66 or 68 (depending upon which way the door was swung open) engaged with the roller will coact with the roller to urge the door to swing back in the direction opposite to the direction of its movement when it was swung open. When the force holding the door open is released, the spring and roller/cam arrangement will cause the door post assembly and the door to rotate back to closed position. It is possible that when the door moves back from open position, it may swing past the closed position, i.e., the high rest point of the cam may swing past roller 36 far enough for the latter to be engaged by the other inclined surface 66 or 68. In such event, spring 40 will be recompressed and tend to bring the door to a stop and then cause it to back up to closed position.

Making the door post in two sections is preferred for ease of assembly and installation. Because (1) spring 40 must be placed under a certain amount of compression when it is installed in order to force the cam to engage the roller, and (2) the spring 40 must be quite stiff in order to be able to cause the heavy door to close automatically, installing the spring so that it holds the cam in engagement with roller 36 requires a considerable force. The force required to compress spring 40 between cam 38 and angle iron 32 is more easily applied in a factory than it is at the installation site. By utilizing a relatively short door post section 24B and a relatively long door post section 24A, it is possible to provide two discrete assemblies: (1) an assembly consisting of door 20, door mount 22, door post section 24A and flap 30; and (2) an assembly consisting of bearing 28, door post section 24B, angle iron 32, the sub-assembly consisting of roller 36 and stub shaft 34, cam 38, guide pin 56, spring 40, and roll pin 46. Assuming that at least the first of said discrete assemblies has been pre-fabricated, when a door as shown in FIG. 1 is to be assembled, the installer first attaches angle iron 32 to a door frame. Then the lower door post section 24A with door 2 attached and bearing 26 slipped over its lower end, is inserted into upper door post section 24B and secured in place by roll pin 78. Finally the lower bearing 26 is anchored to the door frame by means of suitable fasteners such as lag bolts (not shown).

Figure 4:
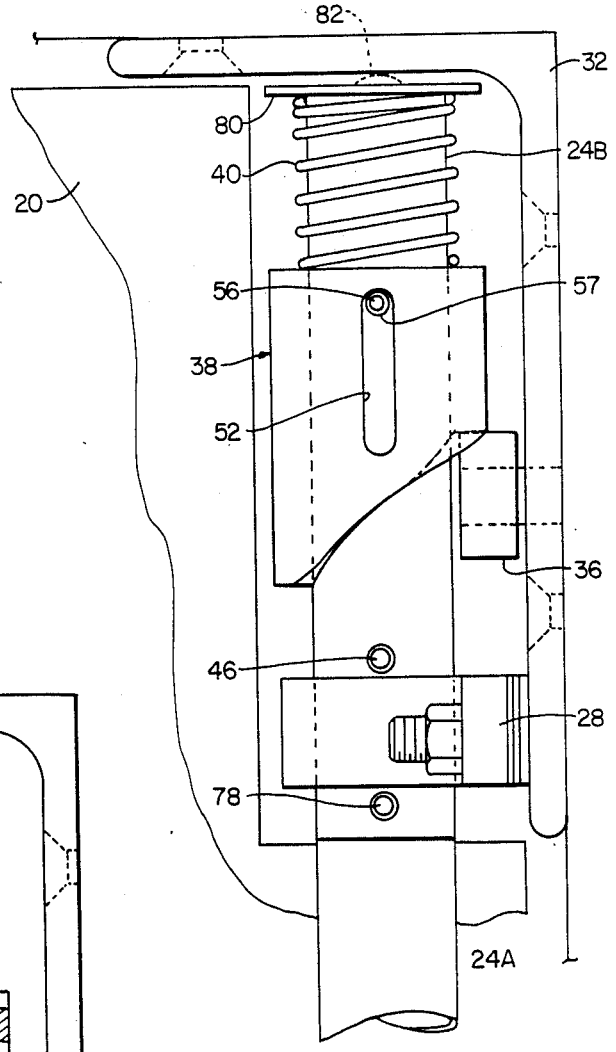
FIG. 4 is an enlarged fragmentary view similar to FIG. 2 of an alternative embodiment of the invention.

FIG. 4 shows a modification of the invention. In this alternative embodiment, the construction is the same as that shown in FIGS. 1–3 except that a stop plate 80 is welded to the upper end of door post section 24B. In this configuration spring 40 presses against stop plate 80 instead of angle iron 32 or the door frame. This results in easier factory assembly and less friction and/or noise in opening and closing the door as the spring 40 and stop plate 80 rotate with the door post assembly, instead of the spring having to slip relative to the cam follower or the angle iron. As with the embodiment of FIG. 1, as the door is rotated, the door post assembly 24A,24B is prevented from lifting by action of roll pin 78 whose ends project from the door post assembly far enough for it to overlap the underside of bearing 28.

As an alternative measure, the embodiment of FIG. 4 may be modified by shortening roll pin 78 so that it cannot engage the underside of bearing 28 (or eliminating roll pin 78 as may be feasible when the door post consists of a one piece rod or tube) and providing stop plate 80 with a rounded protuberance (as shown in phantom at 82) that engages angle iron 32. The engagement of protuberance 82 with angle iron 32 will prevent the door from lifting as it is rotated. If desired the protuberance 82 may be replaced with a ball bearing unit having a ball engaged with angle iron 32 and a ball-retaining section attached to stop plate 80. If a one piece post is used in the embodiment of FIG. 4, a retaining pin similar to roll pin 78 may be installed at the lower end of the post in position to extend under and engage the lower surface of lower bearing 26.

It is to be noted that stop plate 80 may be replaced by a washer slidably surrounding door post section 24B and engaging the upper end of spring 40, and a roll pin installed in that door post section between its upper end and the washer, whereby the roll pin will hold the washer in place and allow it to function as a retainer for spring 40. As a further alternative, the washer may be omitted so that the spring is retained solely by the roll pin.

Of course, in order to improve the performance of the embodiments of FIGS. 1–3 and 4, it is possible to mount roller bearings on the projecting ends of guide pin 56, e.g., as shown in FIG. 4, to facilitate its movement along holes 52. Roller bearings also may be mounted on the projecting ends of roll pins 46 and 78 to facilitate relative movement between those pins and bearing 28.

Figure 5:
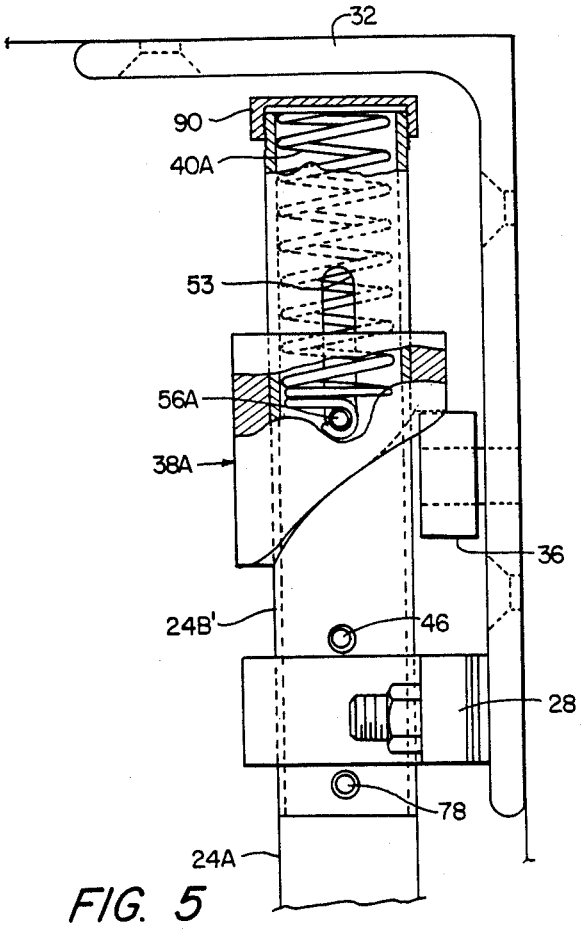
FIG. 5 is an enlarged fragmentary view of a second alternative embodiment of the invention.
Figure 6:
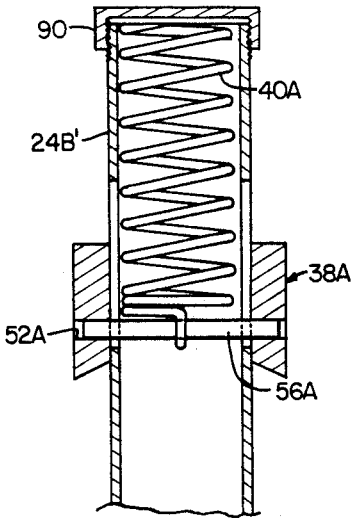
FIG. 6 is a cross-sectional view in elevational, taken at a right angle to FIG. 5, of the second alternative embodiment of the invention.

Another alternative embodiment of the invention is shown in FIGS. 5 and 6. This embodiment is identical to the apparatus of FIGS. 1–3 except that certain changes have been made involving the cam, the upper door post section, and the load spring. More particularly, the cam 38A is identical to the one shown in FIGS. 1–3 except that it has round holes 52A rather than elongated holes 52; door post section 24B' is identical to door post section 24B except that it has a pair of axially elongated, diametrically-opposed holes 53 and is closed off at its upper end by an end wall as shown at 90; and spring 40A is similar to spring 40 except that it is mounted within rather than outside of upper door post section 24B'. Holes 53 have a length measured along the axis of the door post section equal to the length of the elongated holes 52 of the preferred embodiment shown in FIGS. 1–3. Guide pin 56A is fixed in round holes 52A, e.g., by a press fit. Guide pin 56A, like guide pin 56, has a length equal to or slightly less than the outer diameter of the cam. The upper end of spring 40A bears against end wall 90 while its lower end is wrapped around and is secured to guide pin 56A.

Operation of the embodiment of FIGS. 5 and 6 is essentially the same as that of the apparatus of FIGS. 1–3, except that in this case reciprocal motion of cam 38 relative to the door post is the result of reciprocal motion of guide pin 56A in the axially-elongated door post holes 53. When the door is swung open, cam 38A is rotated and, as it does so, it is lifted by roller 36. The lifting action of the cam involves upward movement of guide pin 56 in holes 53. Since spring 40A is attached to guide pin 56, it will be compressed as guide pin 56 moves up in holes 53.

The action of the cam relative to roller 36 in the embodiment of FIGS. 5 and 6 is the same as that which characterizes the embodiment of FIGS. 1–3. Therefore, the upper door post section 24B' must be prevented from lifting as the door is opened. This may be accomplished by means of roll pin 78 co-acting with upper bearing 28, or by means of a roll pin co-acting with lower bearing 26. Another way to restrict lifting of the door post is to extend the door post so that its upper end can engage the overlying portion of angle iron 32 or, if no angle iron is used, the overlying portion of lintle 16.

It is to be noted that the end wall 90 may take various forms. Thus, as shown, it may be a cap which is screwed onto an external thread on the door post. Alternatively, it may be a plug which is inserted into the upper end of the door post and secured there by a screw connection, a force fit or by welding.

Figure 7:
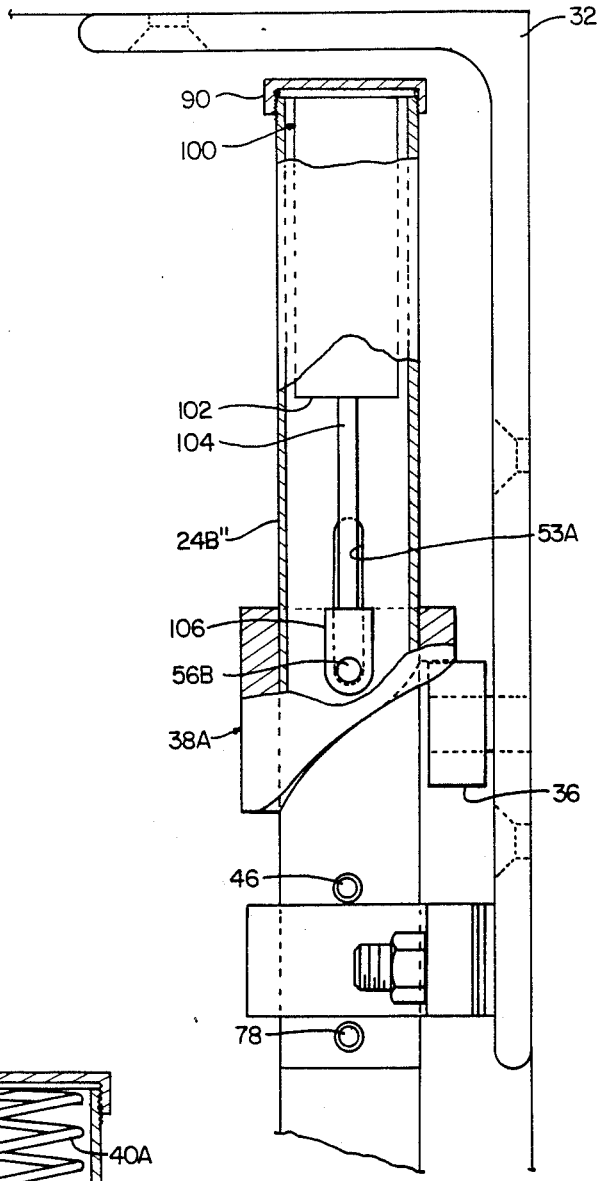
FIG. 7 is an enlarged fragmentary view in elevation of a third alternative embodiment of the invention.

FIG. 7 illustrates another modification of the invention which utilizes a different form of means for biasing the cam against the roller. In this case a pneumatic spring 100 is used in place of compression spring 40A. Pneumatic springs are well known, being used on automative vehicles as well as in other fields. Essentially the spring 100 is mounted within the upper end of the door post 24 and consists of a cylinder 102 and a piston rod 104 which is capable of reciprocating within the cylinder.

Cylinder 102 is fixed to the door post by suitable means, while piston rod 104 has a yoke 106 with a hole for receiving guide pin 56B. By way of example, cylinder 102 may have a peripheral flange 103 which is captivated between the upper end edge of door post section 24B'' and a retaining cap 90 which is screwed onto the door post section. The opposite ends of pin 56B extend through elongated door post holes 53A and are anchored in circular diametrically opposed holes in cam 38A. Guide pin 56B is slidable in door post holes 53A, so that the cam 38A can move axially on the door post. The interior of cylinder 102 is pneumatically pressurized, so as to normally urge the piston rod to extended position. The door post with the cam attached is mounted to angle iron 32 by means of bearing 28, and roll pin 78 is applied to prevent the post from lifting under the influence of roller 36 when the door is swung open. The pneumatic spring is located so that it forces guide pin 56B to the bottom ends of holes 53A before the cam is engaged with roller 36, and the roller is located along the angle iron so that it forces the cam to preload the spring a slight amount when the roller is engaged with the high rest point of the cam. This assures that the door will stay closed until a turning force of a predetermined magnitude is applied to it. When the door is swung open, the cam will rise under the pressure exerted by roller 36, causing the spring to contract and energy to be stored by compression of the fluid in cylinder 102. When the door is released, the pressure build-up in cylinder 102 will cause the piston rod to be re-extended and thereby cause the cam to rotate relative to the roller resulting in automatic closing of the door.

Figure 8:
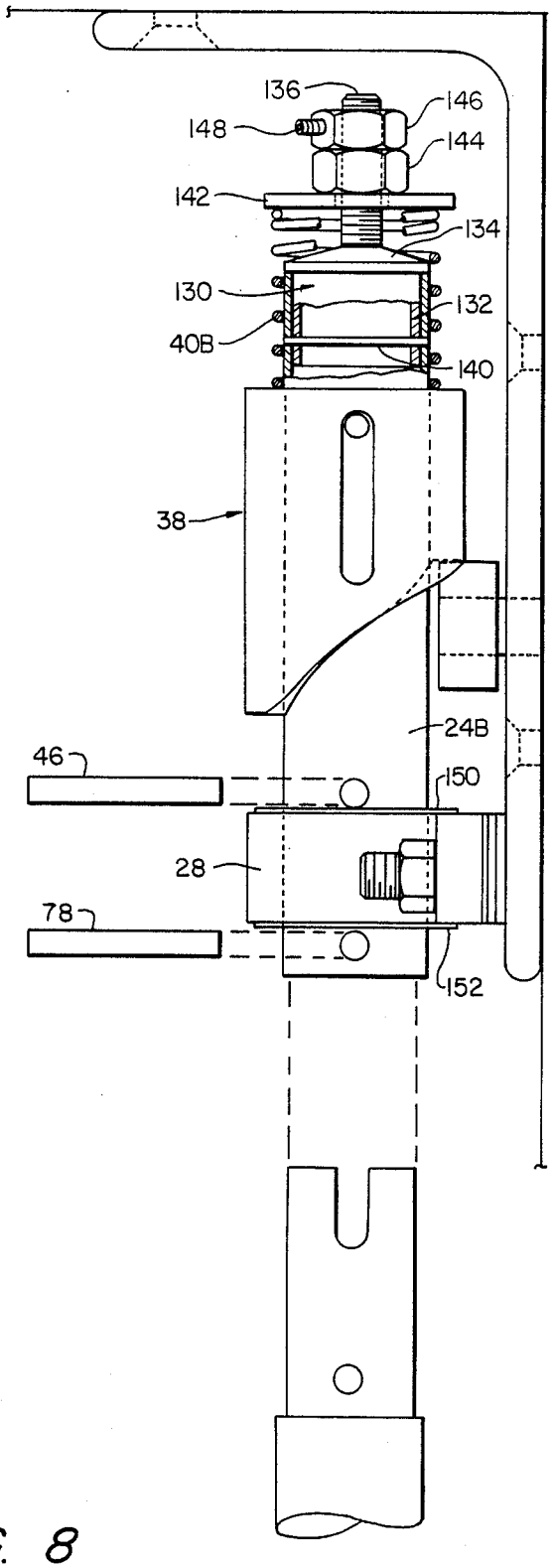
FIG. 8 shows a further alternative and preferred embodiment of the invention.

FIG. 8 shows a preferred embodiment of the invention which improves upon the embodiment shown in FIG. 2 by provision of means for varying the resistance offered by spring 40.

In the embodiment of FIG. 8, the upper end of the door post section 24B is hollow and a plug assembly 130 is disposed within the upper end of that door post section. The plug assembly 130 serves as an extension of post section 24B and comprises a cylindrical section 132 that extends within and engages door post section 24B, a conically-shaped disk-like section 134 formed integral with section 132, and a threaded rod-like extension 136 formed integral with section 134.

The plug assembly is securely locked to door post section 24B by a pin 140. Surrounding threaded rod-like extension 136 is a washer 142 having an interior diameter which is oversized relative to that of rod-like section 136. Washer 142 acts to hold a compression spring 40B against the upper end surface of cam 38. Screwed onto the threaded rod-like extension 136 are two nuts 144 and

MISSING PAGE TEMPORARY NOTICE

PATENT # 4951351 FOR ISSUE DATE 8-28-1990

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

COLUMN # 9-10

MISSING PAGE TEMPORARY NOTICE

PATENT # 4951351 FOR ISSUE DATE 8-28-1990

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

COLUMN # 11-12 ally cooperating means on said cam and post respectively; and compression spring means for resiliently urging said cam along said axis in a first direction to maintain said contoured surface engaged with said roller;

said contoured surface being formed so that while engaged with said roller (a) if a turning force is applied to said door to cause it to rotate about said axis to an open position, said cam will be forced to rotate and simultaneously to move along said axis in a second direction against the force of said compression spring means, and (b) if thereafter said turning force is removed, said compression spring means and said roller will coact to force said cam to move along said axis in said first direction and simultaneously to rotate so as to restore said door to a closed position.

25. Apparatus according to claim 24 wherein at least that portion of said door post that is surrounded by said cam is hollow, and further wherein said coupling means comprises a pair of diametrically opposed holes in said post and a pin attached to said cam and extending through said holes, said holes being elongated in a direction that is parallel to the axis of rotation of said post, and said pin being sized so as to make a slidable fit in said holes, whereby to permit movement of said cam relative to said post along said axis.

26. Apparatus according to claim 24 wherein said coupling means comprises a pair of diametrically opposed holes in said cam and a pin attached to said post and extending into said holes, said holes each being elongated in a direction parallel to the axis of rotation of said post, and said pin being sized so as to make a slidable fit in said holes, whereby to permit relative movement of said cam and post along said axis.

* * * * *

UNITED STATES PATENT AND TRADEMARK OFFICE

CERTIFICATE OF CORRECTION

PATENT NO. : 4951351

DATED : August 28, 1990

INVENTOR(S) : Alan Eckel

It is certified that error appears in the above-identified patent and that said Letters Patent is hereby corrected as shown below:

Claim 15, column 11, line 19, "included" should be -- includes --;

Claim 21, column 11, line 53, "comprising" should be -- comprises --;

claim 23, column 12, line 31, "am" should be -- cam --; and

Claim 23, column 12, line 47, "springs" should be -- spring --.

Signed and Sealed this

Third Day of March, 1992

*Attest:*

HARRY F. MANBECK, JR.

*Attesting Officer*

*Commissioner of Patents and Trademarks*